US006942901B1

(12) United States Patent
Van Tassel et al.

(10) Patent No.: US 6,942,901 B1
(45) Date of Patent: Sep. 13, 2005

(54) FABRICATION OF PARTICULATE TAPES BY ELECTROPHORETIC DEPOSITION

(75) Inventors: Jonathan Van Tassel, State College, PA (US); Clive A. Randall, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 09/478,702

(22) Filed: Jan. 6, 2000

Related U.S. Application Data

(60) Provisional application No. 60/115,075, filed on Jan. 7, 1999.

(51) Int. Cl.[7] ..... H05C 1/00; B29C 47/96

(52) U.S. Cl. ..... 427/458; 427/469; 427/475; 427/482; 427/485; 425/174.8 R; 425/174.8 E

(58) Field of Search ..... 427/475, 485, 427/482, 314, 458, 469, 474, 550; 425/174.8 R, 174.8 E; 428/206, 457, 698

(56) References Cited

U.S. PATENT DOCUMENTS

| | | | | |
|---|---|---|---|---|
| 4,130,472 A | | 12/1978 | Kaplan et al. | 204/181 N |
| 4,357,222 A | | 11/1982 | Lucek | 204/181 F |
| 4,482,447 A | * | 11/1984 | Mizuguchi et al. | 204/181 N |
| 4,714,646 A | | 12/1987 | Fletcher et al. | 428/204 |
| 4,778,719 A | * | 10/1988 | Jagannathan | 428/323 |
| 4,794,048 A | | 12/1988 | Oboodi et al. | |
| 4,810,339 A | | 3/1989 | Heavens et al. | 204/180.1 |
| 4,846,891 A | | 7/1989 | Braun | 106/436 |
| 4,865,703 A | * | 9/1989 | Jagannathan | 204/471 |
| 4,975,417 A | | 12/1990 | Koura | 505/1 |
| 5,175,928 A | | 1/1993 | Grabbe | |
| 5,194,129 A | | 3/1993 | Kerkar et al. | 204/181.5 |
| 5,246,916 A | | 9/1993 | Mooney et al. | 505/1 |
| 5,258,044 A | | 11/1993 | Lee | 623/66 |
| 5,336,381 A | * | 8/1994 | Dalzell et al. | 204/180.2 |
| 5,415,748 A | * | 5/1995 | Emiliani et al. | 204/181.5 |

FOREIGN PATENT DOCUMENTS

| | | | | |
|---|---|---|---|---|
| EP | 475592 A2 | * | 3/1992 | C08J/7/04 |
| JP | 8078274 | | 3/1996 | |
| JP | 8306582 | | 11/1996 | |
| WO | WO 00/40398 | * | 7/2000 | |

OTHER PUBLICATIONS

Herbert, J. M., Ceramic Dielectrics and Capacitors, 1985, pp. 78–83, 188–193.

Adair, J.H., et al., A Review of the Processing of Electronic Ceramics with an Emphasis on Multilayer Capacitor Fabrication, Journal of Materials Education, 1987, pp. 75–118.

M.S.J. Gani, Electrophoretic Deposition—A Review, Industrial Ceramics vol. 14 N.4, 1994, pp. 163–174

Sarkar, Partho, et al., Electrophoretic Deposition (EPD): Mechanisms, Kinetics, and Application to Ceramics, Journal of the American Ceramic Society, vol. 79, No. 8, 1996, pp. 1987–2002.

* cited by examiner

*Primary Examiner*—Rena Dye
*Assistant Examiner*—J. M. Gray
(74) *Attorney, Agent, or Firm*—Reed Smith LLP

(57) ABSTRACT

A single or multi-component particulate tape and a method and apparatus for making the single or multi-component particulate tape. More particularly, the present invention relates to a single or multi-component particulate tape and method for making a single or multi-component particulate tape using the process of electrophoretic deposition. These tapes and tapes produced using these methods can be used to make single or multi-layer electronic devices such as capacitors, varistors, inductors, and the like, as well as structural laminate components. The method comprises casting a tape by electrophoretic deposition and also or alternatively depositing additional functional materials on or into the cast tape by electrophoresis.

20 Claims, 6 Drawing Sheets

FABRICATION OF PARTICULATE TAPES BY ELECTROPHORETIC DEPOSITION

This application claims the benefit of the earlier filing date of provisional application No. 60/115,075 filed on Jan. 7, 1999.

FIELD OF THE INVENTION

The present invention generally relates to single or multiple component particulate tapes and methods for making the same. More particularly, the present invention relates to single or multi-component particulate tapes and methods for making the same using electrophoretic deposition.

BACKGROUND OF THE INVENTION

A particulate tape is a ribbon or sheet of a particulate material in which the particles are held together, for example, by a polymer binder or matrix.

Particulate tapes are used in the manufacture of a variety of products. In the simplest case, the particulate tape itself can be the product. An example of this is magnetic recording tape which is used in tape form in video cassettes or cut into disks for use as media in computer floppy disks. This tape is made up of magnetic particles in a polymer matrix with a polymer film backing for strength.

Another use of particulate tapes is as an intermediate in the manufacture of more complex parts, particularly ones having a laminate structure. This can include structural components such as shells or panels made by tape lay up, or tubular structures made by tape winding. These structures can be used "as is," however, it is usually desired to form a dense part having only the properties of the material that is contained in particulate form. In this case the laminated part will go through a process whereby the binder is removed, followed by a heat treatment to sinter the particles, thereby forming a solid, dense structure.

One of the more complex and demanding uses of particulate tapes is as the layers in the manufacture of multi-layer electronic devices and circuits. Multi-layer fabrication can be used to make single element electronic devices such as inductors, resistors, capacitors, transformers and transducers, for example. Multi-layer fabrication can also be used to make parts that include more than one device and more than one kind of device, along with conductor paths to connect these devices. The tapes used to form these parts must incorporate patterns of different particulate materials both in the plane of the tape and through the thickness of the tape to connect adjacent layers.

The current method of manufacture of these multi-layer electronic components begins with making a generally uniform, single component particulate tape. There are several possible methods for making these tapes including: waterfall casting, dip coating, and spraying, for example. However, the most common process is doctor blade tape casting, which is now described. An example doctor blade apparatus for casting a tape is shown in FIG. 1.

The first step in casting a particulate tape is forming a slip (or slurry) which is a suspension of the powder (particulate) material of which the tape is to be made. The slurry typically includes the particles, a solvent to make the slurry fluid, an organic dispersant that coats the particles so individual particles can slide over and past each other in the slip, and a binder to give the tape the mechanical properties necessary for handling after drying. The solvent dissolves the binder and has sufficient volume and sufficiently low viscosity to allow the slurry to flow. As the slurry dries, the binder coats the solid particles and bind them together.

To cast a tape, the slip is placed into a hopper having an open bottom end placed over a moving carrier. At the trailing edge of the bottom of the hopper, there is a small gap parallel to and just above the surface of the carrier. The height of this gap can be adjusted by moving a doctor blade, located at the top of the gap, up and down. As the carrier passes under the slip hopper, it draws a layer of the slip with it. The thickness of the layer of slip on the surface of the carrier is determined by the height of the doctor blade and the flow characteristics of the slip. The result is a thin, uniform layer of slip on the surface of the tape carrier.

Once the slip is cast onto the carrier, it is dried to form a tape that can be handled in the subsequent processing steps. As the layer of cast slip is conveyed on the carrier away from the hopper, the solvent evaporates. This evaporation can be controlled by passing the tape through an elongated, temperature and atmosphere-controlled drying chamber. During drying, the particles are typically pulled together to final density by capillary forces.

To create electronic devices from the cast tape, additional components need to be added to the cast tape. For example, for multi-layer capacitors, particles of a conductive material need to be printed onto the surface of a tape to form inner metal electrodes in the final sintered device.

If internal interconnections between layers are needed in the final device, vias must first be added. Vias are formed by mechanically punching holes in the tape and refilling the holes with a particulate paste. This paste contains a powder which, when sintered, will electrically or magnetically interconnect two layers.

After the vias have been punched and filled, patterns of conductors and other materials are printed on the surface of the tape. These additional features are printed onto the surface of the tape in the form of a thick film ink or paste. While there are a variety of printing processes that can be used, the most commonly used process is screen printing. In this process, a thin metal screen is pressed against the tape. The screen has a pattern of open and filled holes which correspond to the pattern of ink that is to be printed on the tape. The ink is placed on top of the screen, and a rubber squeegee is passed over the top of the screen, forcing the ink into the open holes in the screen. The ink sticks to the surface of the tape, and when the screen is pulled off, a pattern of ink is left on the surface of the tape. The ink should flow somewhat so as to fill in the gaps between adjacent holes, but should not flow so much as to destroy the edge definition of the pattern being printed.

Once these multi-component tapes have been formed they are stacked, laminated, and cut; the binder is removed; and the part is sintered. The stacking process involves careful alignment of the tapes to insure that the features printed on the tapes align in the vertical direction. Lamination is a process of pressing the tapes together at a slightly elevated temperature to weld them into a single body that will not delaminate during sintering. The elevated temperature plastically deforms the binder, which allows the particles to move and create a more intimate contact between the layers. In cases where the tape is too thin to be handled independently, it is left on a carrier until it is laminated to a stack, after which the carrier is peeled off. The stack is built up by laminating one layer at a time. The stack is then cut into individual parts, the polymer binder is removed—usually by heat treatment in a controlled atmosphere—and the parts are sintered.

Finally, after the part is sintered, external interconnections between layers can be added, if necessary. The conductor patterns to be interconnected are designed to intersect the cut edge of the part at a common point. All of the conductors that are exposed on the side of the part at that point can then be interconnected by applying a vertical strip of a conductive material, known as an edge connector, to the side of the part.

The simplest example of using an edge connector is the multi-layer capacitor shown in FIG. 2. In this device, it is desired to connect alternating layers of conductor 27 (separated by intervening layers 28) to the opposite poles of the capacitor. To do this the capacitor is designed as a multi-layer rectangular block 30 with even numbered conductor layers intersecting one end of the block and odd layers intersecting the opposite end (FIG. 2B). After the part is sintered, it is tumbled in an abrasive powder to polish the end of the block, assuring a good contact surface on conductor layers at each end. A conductive ink, frequently referred to as termination compound, is then applied to each end of the block 32. This ink is then dried and sintered in a second heat treatment to form the electrical interconnect between these alternating layers.

In view of the foregoing, a need has been recognized in connection with the provision of single and multiple component particulate tapes that can be produced with one or more of the following characteristics: improved uniformity of particle packing, relatively uniform thickness of multiple component tapes, reduced thickness of the complete tape as well as of individual component layers within a tape, improved lateral resolution of component patterns on and in the tape, and the forming of patterns of components that extend through the thickness of a multi-component tape.

SUMMARY OF THE INVENTION

The present invention broadly contemplates, in accordance with at least one presently preferred embodiment, single or multiple component particulate tapes, and a method for creation of the same, wherein one or more components are formed by electrophoretic deposition of the particulate material.

The present invention also contemplates, in accordance with at least one presently preferred embodiment, a single component, uniform, continuous particulate tape, and a method for forming the same, wherein the tape is formed by the electrophoretic deposition of a particulate material onto a uniform conductive surface with a binder introduced into the deposition by any of a variety of means.

The present invention also contemplates, in accordance with at least one presently preferred embodiment, a multi-component tape, and a method for forming the same, wherein some components are deposited electrophoretically and others are formed by other means.

The present invention also contemplates, in accordance with at least one presently preferred embodiment, a patterned particulate and a method for the electrophoretic deposition of a particulate material onto a patterned electrode on a carrier followed by the transfer of the patterned particulate deposition from the deposition carrier to the surface of another tape.

The present invention also contemplates, in accordance with at least one presently preferred embodiment, a continuous thickness tape, and method of forming the same, wherein materials are deposited on a pattern of alternately energized electrodes. The tape may be formed such that it has areas of different through thickness components as well as areas where different components are layered in the plane of the tape.

BRIEF DESCRIPTION OF THE DRAWINGS

The present invention and its presently preferred embodiments will be better understood by reference to the detailed disclosure hereinbelow and to the accompanying drawings, wherein.

DESCRIPTION OF THE PREFERRED EMBODIMENTS

As used herein, a particulate tape is defined as a ribbon or sheet of one or more particulate materials that are held together, for example, by a polymer binder or matrix. A tape is not limited to specific physical sizes, shapes, properties, or orientations, and is not limited by conventional notions of "tapes" in other fields of the scientific arts. A tape may be patterned and need not be continuous.

As used herein, a component of a particulate tape is defined as a spatially defined region of the tape containing particles that have a defined chemistry, morphology, orientation or crystal structure.

As used herein, a carrier is defined as the surface on which a particulate tape is formed. The carrier may be used to hold the tape in subsequent process steps, but it is not necessarily incorporated into the final product. The carrier can take the shape of a sheet, ribbon, belt, drum or other medium.

Figure 1:
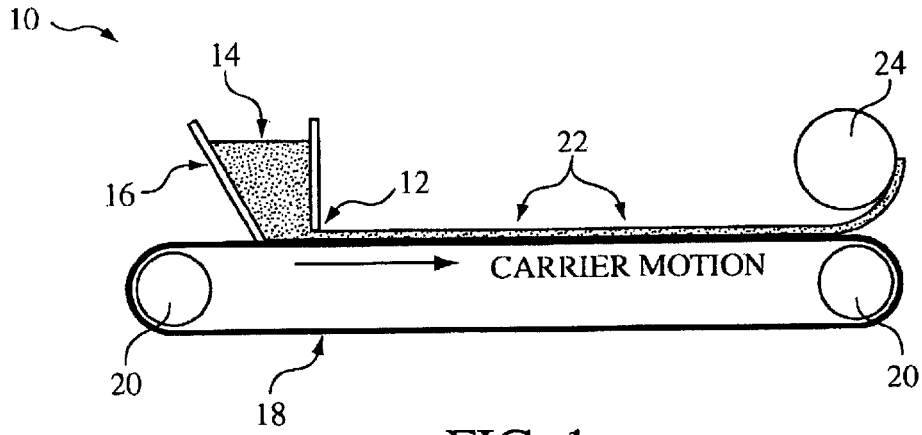
FIG. 1 is a side view of a conventional doctor blade tape casting process.

As described above, conventional tape casting methods suffer from various physical limitations. Although several tape creation methods are known, a common apparatus will now be briefly described. FIG. 1 shows a conventional tape casting apparatus 10 using a doctor blade 12. Here, the slip suspension of particulate material 14 is placed in a hopper 16 that has a doctor blade 12 on one bottom edge. The tape carrier 18 provides a movable surface shown by the arrow in FIG. 1. As the carrier 18 is moved by rollers 20 past the hopper 16, a thin layer of slip suspension 22 is deposited on the carrier 18. As this layer 22 dries, a tape is formed. Once mechanically stable, the tape can be rolled for storage on take-up spool 24, or cut into sheets to be later used.

Secondary functional components are added to the tape by forming vias through the tape or printing components onto the surface of the tape. As described above, these conventional processes suffer from many physical limitations that prevent multi-layer devices from decreasing in size and increasing in reliability.

In current processes used in the forming of particulate tapes, the particulate components are moved into place by mechanically moving a slip or ink of the particulate material into the desired position and form. The final density in the tape is achieved by evaporating the solvent used to make the slip or ink fluid. Drying is an inherently unstable process where lower density regions with larger pores will dry faster than higher density regions. The result is that as low density areas dry, the capillary forces will pull together higher density regions increasing their density. On the microscopic scale, this can cause variations in the network of interparticle contacts, leading to the formation of pores during sintering. This can be an especially significant problem when forming layers that are only a few particles thick. Furthermore, there is a desire to reduce the size of electronic parts. This creates a need to reduce the scale of the particulate tapes used to make these parts. As the scale of tapes is reduced, the mechanical processes used to form the tapes may be limited. The height of the doctor blade in tape casting is limited by the scale over which the slurry can be treated as a continuous fluid medium. The thickness of screen printed patterns is limited by the thickness of the screen, and the lateral resolution is limited by the spacing between adjacent screen holes. Via size will be limited by the size of holes that can be punched into a tape. Below certain sizes the mechanical devices used to form multi-component tapes may not have the mechanical strength to be used in production environments.

Figure 3A:
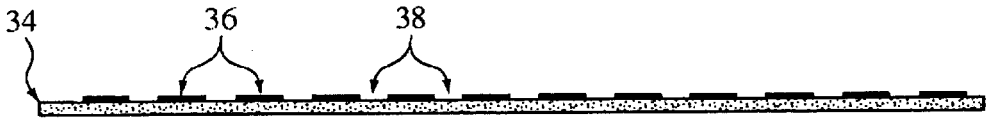
FIGS. 3A and 3B are side views of one layer of a conventional multi-component particulate tape showing uneven layer thickness (3A) and the resulting nonuniform component density (3B)
Figure 3B:
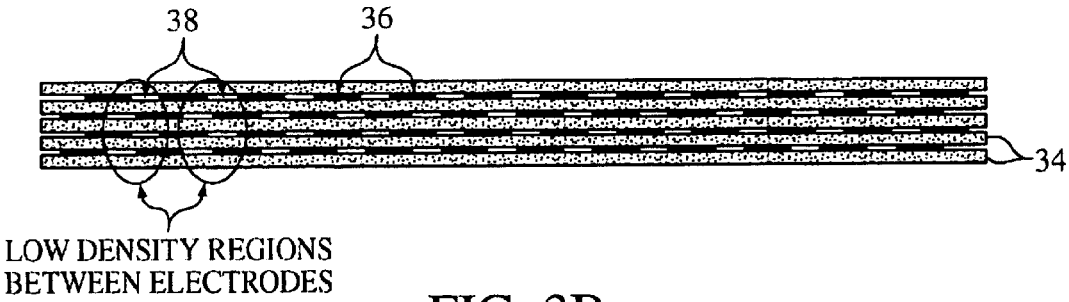

When multi-component tapes are formed by printing a patterned second component 36 onto a uniform thickness tape 34 of the first component (FIG. 3A), the resulting tape is thicker where the printed component 36 is added. When several tapes are stacked (FIG. 3B), there will be low density regions in the stack where the tapes are thinner 38. Plastic deformation during lamination can fill in some of these low density regions, however, these regions will remain at the edges of the printed components. These low density regions can result in incomplete lamination and weak, porous regions in the laminate. This can lead to delamination or cracking of the multi-layer device either during sintering or in use.

The present invention, in accordance with at least one presently preferred embodiment, can reduce or prevent one or more of the unwanted effects described above, among others.

Electrophoretic deposition, in general, is a process whereby electrostatically charged particles suspended in a fluid medium migrate in response to an applied electric field and deposit onto a conductive surface having an applied potential opposite to the particle charge.

There may basically be three steps to the electrophoretic deposition ("EPD") process in accordance with at least one presently preferred embodiment of the present invention. First, a suspension of charged particles can be produced. Next, an electric field may be applied to the suspension of particles causing the charged particles to migrate toward the oppositely charged electrode (electrophoresis). Finally, the migrating particles may form an adherent deposit (deposition).

In electrophoretic deposition, individual particles move into the deposited layer randomly as separate entities and are consolidated to near final density by the imposed electric field prior to drying of the deposition. The result is an extremely uniform packing of the particulate material and an extremely uniform network of interparticle contacts that will minimize the size of pores generated during sintering. This means that thinner continuous layers can be formed from a given particle size starting material than is possible by other methods. This also applies to the scale of patterned components in a multi-component tape. Electrophoretic deposition has the potential to deposit patterns that have a finer resolution than is possible by conventional techniques.

Figure 2A:
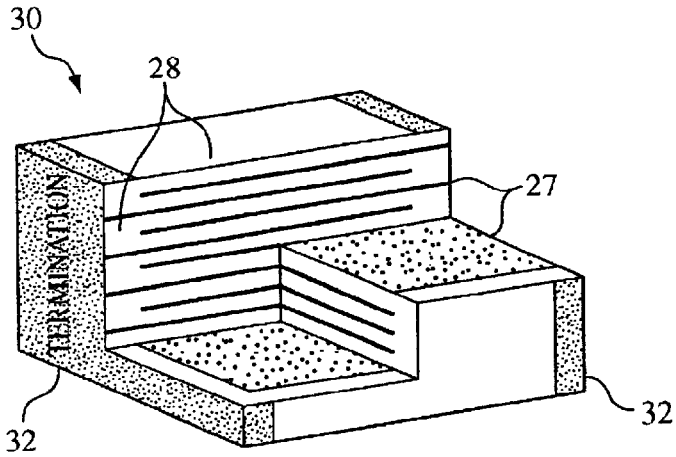
FIG. 2 shows two alternate representations of a conventional laminated capacitor stack showing the electrode layer interconnections by edge termination.
Figure 2B:
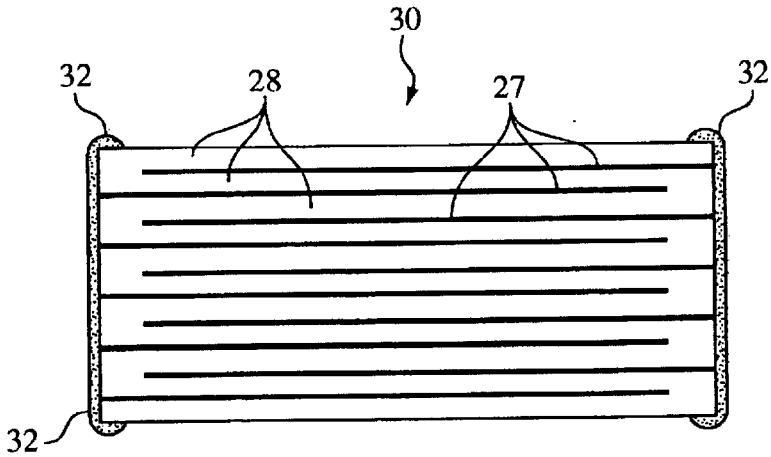

One of the advantages of using electrophoretic deposition in the forming of multi-component tapes is the ability to directly form tapes with two or more through thickness components. Production processes currently in use begin with a uniform single component particulate tape formed by any one of the methods mentioned above. To create through thickness components, material must be removed and replaced, as in via punching and filling, or a second step to add edge connectors must be added (FIG. 2). Because electrophoretic deposition can form material onto complex deposition patterns on the tape carrier, there is no need to begin with a continuous layer. Through thickness second components can be formed directly during the deposition of the second components. These through thickness components can also have a wider variety of patterns formed on smaller scales than is possible with currently used methods.

Any one or more of the above advantages, alone or in combination, provide ultimately for the fabrication of multi-component particulate tapes that can be used to create multi-layer devices and structures with increased quality, reliability, and design flexibility on a smaller scale.

Figure 4:
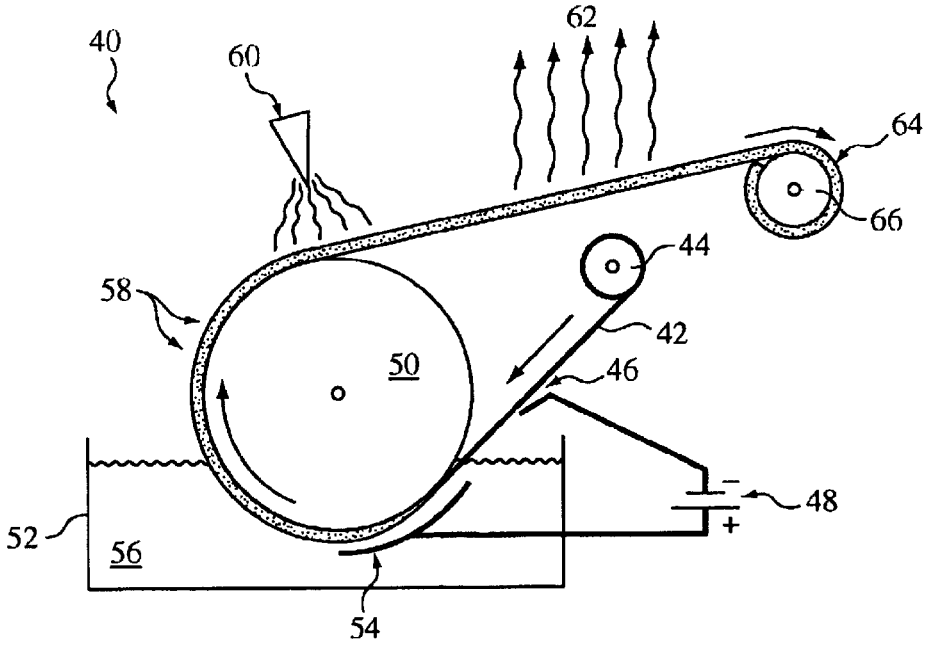
FIG. 4 is a side view of a tape casting apparatus using electrophoretic deposition.

In one preferred embodiment of the present invention shown in FIG. 4, an apparatus and method is used for the formation of a single component, uniform, continuous tape by the electrophoretic deposition of a particulate material onto a uniform conductive surface with a binder introduced into the deposition by any of a variety of means. The formation of a barium titanate particulate tape on a polyester ribbon tape carrier will be described by way of example.

FIG. 4 generally shows an apparatus 40 for electrophoretically depositing a particulate tape. The tape carrier 42 in this case is a ribbon of polyester film that is coated on one side with a metal such as nickel or aluminum to create a uniform conductive surface. The carrier ribbon 42 unwinds from a reel 44 with the conductive side down (away from reel). This conductive side of the carrier 42 moves past and electrically contacts an electrical contact pad 46 that is used to apply a voltage 48 to the conductive surface of the carrier 42. The carrier 42 then passes around a drum 50, the bottom of which is immersed in a deposition bath 52.

The deposition bath 52 contains a counter electrode (or bath electrode) 54 that is oriented generally parallel to the surface of the carrier 42. The deposition bath 52 is filled with a suspension 56 of barium titanate particles in ethanol with a small addition of an acid to give the barium titanate particles a positive surface charge. By applying a voltage 48 between the carrier surface 42 and the counter electrode 54 such that the carrier is negatively charged with respect to the counter electrode, a deposition zone is created between the counter electrode 54 and the carrier surface 42. The positively charged barium titanate particles in this deposition zone will move, under the influence of the induced electric field, toward the surface of the negatively charged carrier 42, where the electric field will cause the particles to deposit. The thickness of this deposition 58 is regulated by the volume fraction of barium titanate particles in the suspension 56, the applied voltage 48, the spacing between the carrier 42 and the counter electrode 54, and the time that it takes for the carrier 42 to pass by the counter electrode 54.

As the carrier 42 with its deposited coating of barium titanate particles 58 moves out of the deposition bath 52, a solution 60 containing a binder, such as polyvinylbutyral, can be sprayed onto the deposition 58. Alternatively, the binder could be made a part of the deposition bath suspension 56. The solvents are then allowed to dry 62 and the formed tape 64, still supported by the carrier 42, is wound up on a take up reel 66.

It should be noted that although the above method and apparatus was described as depositing positively charged particles on a negatively charged carrier, all of the relevant polarities could be reversed in accordance with the present invention. Also, many particulate materials other than barium titanate and solvents other than ethanol can be used and are contemplated by this invention. As previously mentioned, the carrier could also be a sheet, belt, drum or other medium and does not necessarily have to be unrolled and rolled from spools.

The present invention also contemplates, in accordance with another presently preferred embodiment, an apparatus and method for the formation of a multi-component tape wherein some components are deposited electrophoretically and others are formed by other means. By way of example, the apparatus and method will be described in forming a barium titanate tape with an embedded pattern of silver/palladium powder.

Figure 5A:
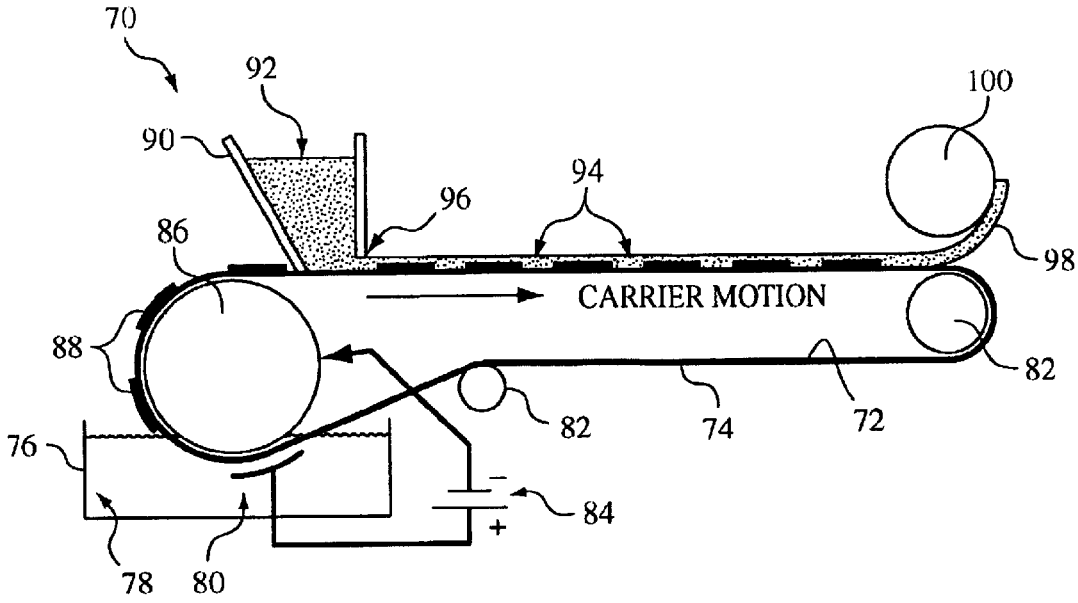
FIGS. 5A and 5B are side views of a tape casting apparatus using electrophoretic deposition and a doctor blade (5A) and the resulting multi-layer device with improved density uniformity (5B)
Figure 5B:
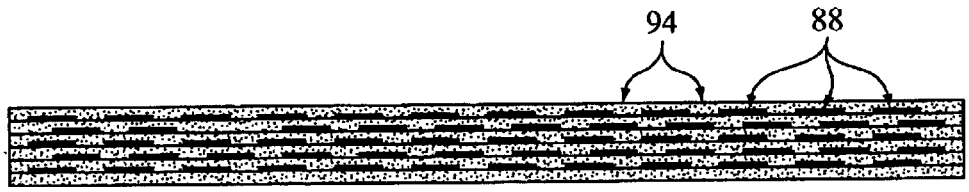

FIG. 5A shows an apparatus 70, including a tape carrier 72 in the form of a stainless steel belt. The surface of the carrier 74 is coated with a thin pattern of a non-conductive polymer, exposing only areas of the conductive stainless steel surface where it is desired to form a deposition. The apparatus 70 also includes an electrophoretic deposition bath 76 containing a particulate suspension 78 and a counter electrode 80. Specifically, the deposition bath 76 may contain a suspension of silver/palladium particles 78. If the silver/palladium particles are suspended in glacial acetic acid, they will develop a positive surface charge by absorption of protons from the solvent.

The carrier belt 72 is fed by optional feeder rollers 82. The conductive steel belt is connected to the negative pole of an external power supply 84. The power supply 84 can be directly coupled to the carrier 72 or can be electrically coupled to the carrier through a conductive guide roller 86. In the deposition bath 76, the counter electrode 80 is connected to the positive pole of the external power supply 84. The power supply 84 is set so as to produce, for example, an electric field of approximately 150 volts/centimeter between the carrier 72 and the counter electrode 80. In such an electric field, the positively charged silver/palladium particles can be made to travel towards and deposit on the areas of the negatively charged carrier 72 that are exposed through the non-conductive polymer layer 74. This process deposits a patterned layer of silver/palladium 88 on the carrier 72 with gaps between adjacent deposits 88.

The carrier 72 with the deposited pattern of silver/palladium powder 88 is then carried out of the bath 76 by the roller 86 and passes under a hopper 90 filled with a standard tape casting slip 92 of, for example, barium titanate particles suspended in a solvent containing dissolved binder. The motion of the carrier 72 pulls a layer of the slip 94 out of the hopper 90 under the doctor blade 96 which controls the overall thickness of the particulate tape. Solvent containing binder will infiltrate from the slip 94 into the silver/palladium particulate depositions 88. After the solvent is dried from the tape, the binder permeating throughout will bind both the barium titanate and silver/palladium particles into one tape of generally uniform thickness 98 that can be removed from the carrier 72 and wound up onto a take up reel 100.

It should again be noted here that the materials used, the apparatus orientation, size and shape, and the voltage polarity, magnitude, and duration were described above only by way of example. Many substitutions are contemplated within the scope of the present invention.

In the traditional process for forming this type of tape, a uniform thickness barium titanate tape would be cast and a silver/palladium particle ink would be screen printed onto the surface of the tape. As previously discussed, a multi-component tape produced in this manner may have an uneven thickness that could cause problems or breakage during lamination, sintering, or even during use of the device.

With electrophoretic deposition, it is anticipated that by casting a material over the top of a patterned deposition, the cast material can flow into the spaces between adjacent areas of deposited material, thereby forming a multi-component tape of uniform thickness. It is also anticipated that the components of the tape that are formed by electrophoretic deposition can have better particle packing, lower thickness, and finer detail sizes.

Figure 6A:
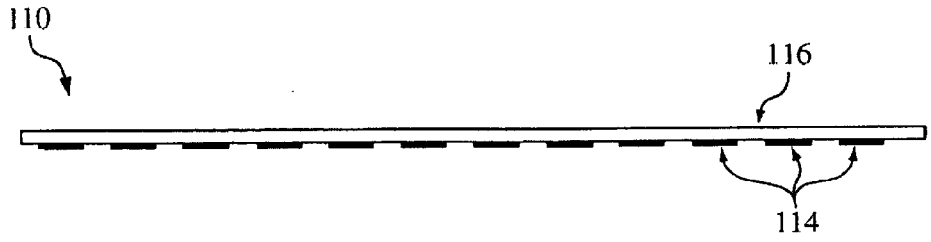
FIGS. 6A and 6B are side views of a laminate layer which has been electrophoretically deposited on a tape carrier (6A) and a multi-layer device produced by laminating the layer onto a laminate stack (6B)
Figure 6B:
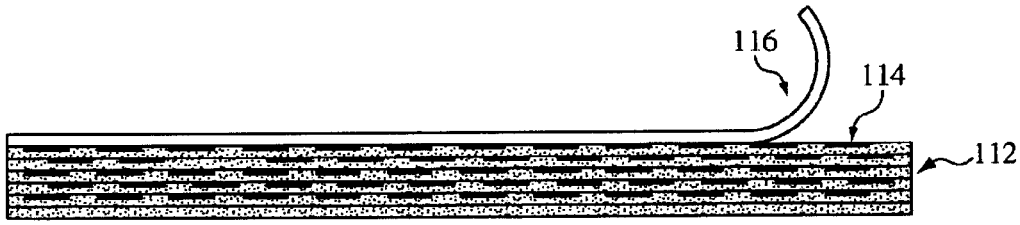

The present invention also contemplates, in accordance with another presently preferred embodiment shown in FIG. 6, an apparatus and method for the deposition of a particulate material onto a patterned electrode on a carrier followed by the transfer of the patterned particulate from the deposition carrier to the surface of another tape. By way of example, the apparatus and method will be described as incorporating a deposited pattern of a secondary component onto an existing laminate stack made up primarily of continuous particulate tape layers.

Preferably, a carrier is provided with a deposition electrode pattern on its surface. For example, the carrier may be a sheet of polyester film with a conductive pattern on its surface formed by sputtered platinum, nickel or other conductive material. This patterned carrier is placed in a deposition bath opposite a counter electrode, and a voltage is applied between the carrier and the counter electrode. The applied voltage causes a layer of particulate material suspended in the deposition bath to be deposited on the carrier in the same pattern as the energized carrier electrode. The carrier with deposited particulate pattern is then removed from the electrophoretic deposition apparatus and taken to an existing multi-layer laminate stack.

As shown in FIG. 6, the carrier with deposit 110 is placed on top of a continuous particulate tape that has already been placed onto laminate stack 112. The deposited particulate pattern 114 faces the top layer of the laminate stack 112 (carrier side 116 away from the laminate stack 112). The carrier 116 is then heated and pressed into the laminate stack 112, which causes the patterned particulate deposition 114 to be incorporated into the top of the laminate stack 112, which is itself laminated to the stack in the same process step. The deposition 114 can either be infiltrated with binder before lamination or can be laminated without previously adding binder, which allows excess binder to flow from the layer below it. After lamination, the carrier is peeled off the top of the stack and may be reused. Another continuous tape can then be placed on top of the stack followed by a carrier with a deposited particulate component pattern. The process can be repeated to add further layers to the laminated stack.

The traditional processes for incorporating a patterned particulate material onto an existing tape or into a laminate stack would be by screen printing. As described above, this traditional screen printing process may only print particulate patterns with limited thickness and resolution.

An advantage of this process using electrophoretic deposition may be the incorporation of secondary components into a laminate stack with better particle packing, decreased thickness and finer detail sizes than are possible with current printing techniques. Although the patterned component formed by electrophoretic deposition added to a tape of uniform thickness may result in a complete layer that is non-uniform in thickness, such non-uniformity will be limited because the electrophoretically deposited layer may be thinner than conventionally fabricated layers. Hence, the resulting non-uniformity can also be limited.

The present invention also contemplates, in accordance with another presently preferred embodiment, an apparatus and method for the formation of a continuous thickness tape wherein different materials are deposited on alternately energized electrode patterns. The tape may be formed such that it has areas of different through thickness components as well as areas where different components are layered in the plane of the tape.

Figure 7:
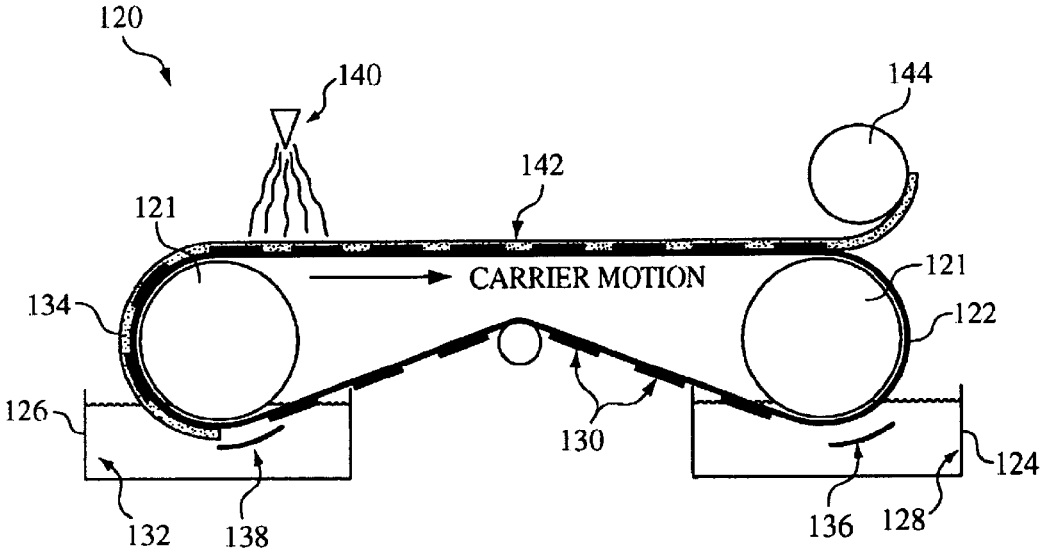
FIG. 7 is a side view of a dual electrophoretic deposition apparatus capable of depositing two different materials on a tape carrier in one process step.

FIG. 7 shows an apparatus 120 for forming a uniform thickness tape of a second component with an embedded pattern of a first component. The tape produced is similar in configuration to the barium titanate tape with an embedded silver/palladium pattern formed by a combination of electrophoretic deposition and tape casting in an embodiment described above, however, in this example both components are formed by electrophoretic deposition.

The apparatus 120 includes optional guide rollers 121 and a carrier 122 in the form of a belt which is provided with two conductive patterns on its surface. Each of the conductive patterns is electrically isolated from the other so that a voltage may be applied to one pattern without affecting the other. The first conductive pattern describes the pattern desired for a first component, and the second pattern fills in substantially all of the balance of the carrier 122 surface. The apparatus is further provided with two deposition baths 124, 126. One bath 124 contains a suspension 128 of the particulate material to form a first component 130, and the second bath 126 contains a suspension 132 for forming a second component 134. Each bath 124, 126 is provided with a separate deposition counter electrode 136, 138, respectively.

As the belt 122 passes through the first deposition bath 124, a voltage is applied between the first electrode pattern and the counter electrode 136 in that bath 124, such that a deposition of the first component in the pattern of the first electrode is deposited 130 on the surface of the carrier 122. The voltage, time in deposition zone, suspension density, etc. are controlled such that the desired thickness of the first component is deposited.

In the second deposition bath 126, voltages are applied between both electrode patterns and the counter electrode 138 so that a layer of the second component 134 is deposited over the entire surface of the tape carrier 122, covering the depositions of the first component 130 already on the carrier. By adjusting the relative voltages applied to the first and second deposition patterns, a thinner deposition of the second component 134 can be made over the already deposited first component 130. This may be adjusted such that the overall thickness of the tape including both components is uniform. After the second deposition, binder 140 can be added to the tape, and the completed multi-component tape 142 can be removed from the carrier and spooled 144.

The potential advantages of this process are the formation of a multi-component particulate tape with components layered in the plane of the tape, that is of uniform thickness with better particle packing overall, and in which the patterned component may be thinner and have greater pattern resolution than is possible using current processes.

The above example is illustrative only. The apparatus for use with the present invention can have one, two, or even more than two electrophoretic deposition baths. The carrier, as mentioned above, can take various forms which can be placed into and removed from the deposition baths by a variety of means.

A further example is given here demonstrating the formation of a tape having both components layered in the plane of the tape as well as components that extend through the thickness of the tape. The specific example as shown in FIG. 8 will be the formation of a tape that can be used to create a multi-layer capacitor that does not need a separate end termination step to interconnect internal electrode layers.

In this preferred embodiment of the invention, the carrier is a sheet of polyester film provided with three surface electrode patterns (150, 152 and 154). A cross-sectional schematic of this carrier is shown in FIGS. 8A–8D.

Initially (FIG. 8A), the carrier may be placed in a first electrophoretic deposition bath containing a suspension of a powdered conductor material such as nickel, and a counter electrode arranged generally parallel to the surface of the carrier. A voltage 156 is applied between the conductive surface pattern for the through thickness conductive component 154 and the counter electrode, such that a deposition of the conductive component is formed on that pattern 160.

Next (FIG. 8B), the carrier is moved to a second electrophoretic deposition bath containing a suspension of a powdered dielectric material, such as barium titanate, and a separate deposition counter electrode. In this bath, deposition patterns 150 and 152 are electrically interconnected and a voltage is applied between these patterns and the counter electrode such that a deposition of the dielectric material is formed on their surface 162, 164.

In a third step (FIG. 8C), the carrier with patterned depositions of the conductor 160 and dielectric 162, 164 components may be placed again into the first deposition bath containing the suspension of the conductor component. The patterned electrode areas 152 and 154 are now electrically interconnected and a voltage is applied between them and the counter electrode so as to form a second deposition layer 166, 168 directly on top of the first deposited layer.

Finally (FIG. 5D), the carrier may be returned to the second deposition bath where a voltage 156 is applied only between pattern 150 and the counter electrode in that bath. This is done to deposit a second layer of the dielectric material 170 on the pattern 150, creating a tape of overall uniform thickness. The completed tape can now be impregnated with binder by dipping into a binder solution, spraying or by other means. Tapes of alternating orientation handled on their carrier can now be laminated onto a stack (FIG. 8E), and the carrier peeled off after lamination and re-used to form additional tapes. By cutting the stack through the center of the continuous vertical conductor component 172 (FIG. 8F), a multi-layer device is created in which, after sintering, alternating internal layers are interconnected. This eliminates the need for an additional process step in the device fabrication where termination compound is added to each end of the capacitor block and sintered.

Figure 8A:
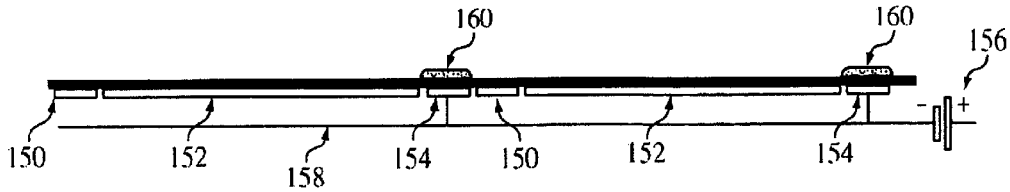
FIGS. 8A–8F illustrate one stepwise method of constructing a multi-layer capacitor using electrophoretic deposition.
Figure 8B:
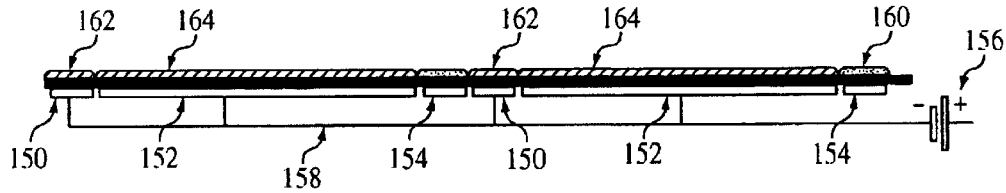
Figure 8C:
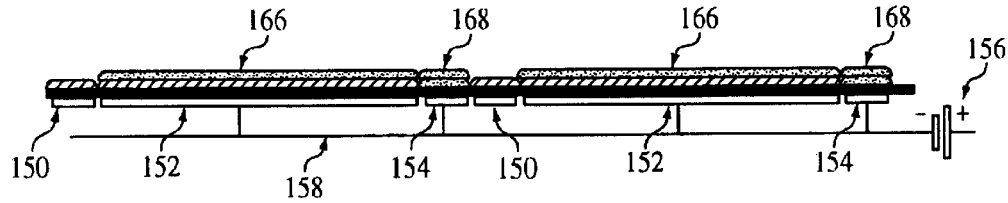
Figure 8D:
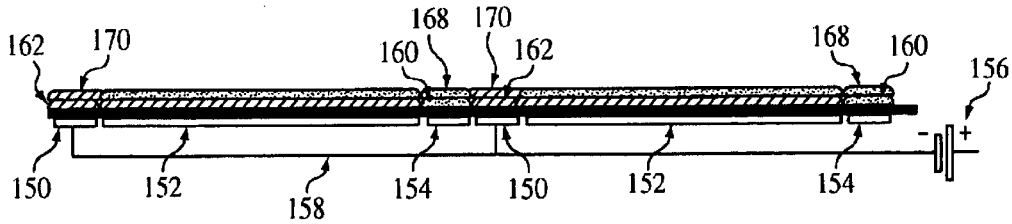
Figure 8E:
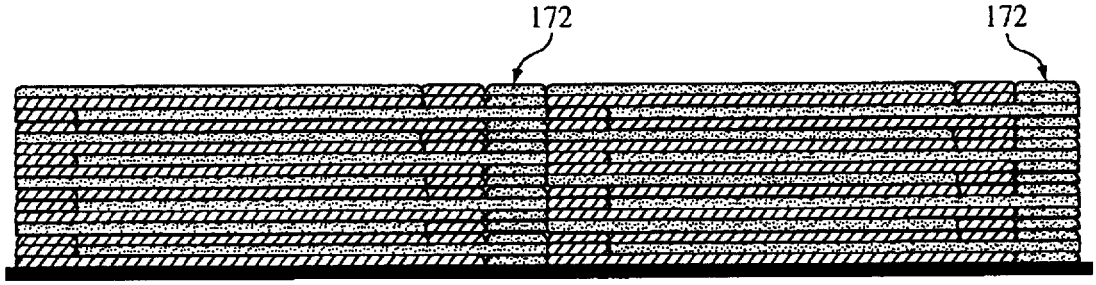
Figure 8F:
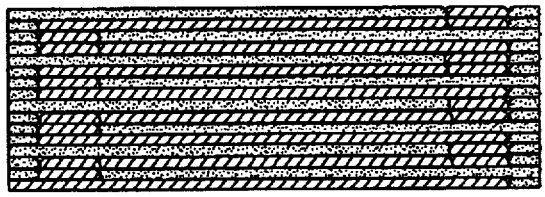

As is shown in the completed tape in FIG. 8D, the tape contains areas where two different materials extend through the thickness of the tape, the dielectric material 162, 170 and conductor material 160, 168. The conventional process used for forming through thickness components is to first cast a uniform, single component tape, punch holes through the tape, and refill the holes with a paste of the second component. This procedure is limited in the size and shape of the holes that can be punched and refilled (via forming). Generally, small holes are limited to a circular shape. Furthermore, this procedure is generally limited to tapes that are thick enough that they can be handled separately from their carrier. The tape must be removed from the carrier for the holes to be punched and the tape must then be placed on a flat surface so that the holes can be refilled with a paste that is even with both sides of the tape. Because the tape formed by electrophoretic deposition in the example above can be handled on its carrier until it is laminated to a multi-layer stack, the need for multiple through thickness components is not the limiting factor in determining minimum thickness of the tape formed.

Some advantages of the invention as presented in the above example include: the formation of a multi-component particulate tape where two or more of the components extend through the thickness of the tape; the formation of multi-component tapes where two or more components extend through the thickness of the tape where the tape is thinner than is possible using other methods; the formation of a wider variety of patterns of through thickness components with smaller possible pattern sizes than can be formed using other methods; and the formation of the above mentioned particulate tapes with better particle packing of all of the components of the tape; among others.

It should be noted that the above-described examples of the present method, device, and apparatus are presented by way of example only, and should not limit the scope of this invention. Specifically, many of the characteristics, features, aspects, materials, and process steps are interchangeable from one embodiment to another. The different materials and embodiments presented were chosen to illustrate examples of the broad scope of the present invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. A method for producing a particulate tape, comprising the steps of:

providing a carrier which includes an electrically conductive area on at least one surface of said carrier, wherein said electrically conductive area is a part of said carrier;

electrophoretically depositing a particulate material onto said conductive area to form a component of said particulate tape; and removing said component from said conductive area of said carrier.

2. The method of claim 1, wherein said electrically conductive area forms a pattern on the surface of the carrier.

3. The method of claim 2, further comprising the steps of:

providing a second patterned electrically conductive area on the carrier which is electrically isolated from said first patterned electrically conductive area; and electrophoretically depositing a second component onto at least one of said first or second patterned electrically conductive areas.

4. The method of claim 1, further comprising the step of:

laminating said electrophoretically formed component to another surface prior to removal from said carrier.

5. The method of claim 1, further comprising the step of:

before said removing step, applying a binder to said electrophoretically deposited component.

6. The method of claim 5, wherein said binder is dissolved in a bath used for said electrophoretic deposition and remains in the deposited component after removal from said carrier.

7. The method of claim 5, wherein said binder is sprayed onto said deposited component before said removing step.

8. A method of forming a single component particulate tape, comprising the steps of:

providing a carrier which includes an electrically conductive area on at least one surface of said carrier, wherein said electrically conductive area is a part of said carrier;

electrophoretically depositing a particulate material onto said conductive area to form said single component of said particulate tape; and removing said particulate tape from said conductive area of said carrier.

9. The method of claim 8, wherein said particulate tape is substantially continuous in the form of a ribbon or sheet.

10. The method of claim 8, wherein said single component is generally dielectric.

11. The method of claim 10, wherein said single component includes at least one material selected from the group consisting of magnesia, alumina, silica, titania, zirconia, barium oxide, lead oxide, bismuth oxide, and a combination of the above materials.

12. The method of claim 8, wherein said single component is formed in a pattern corresponding to a patterned deposition electrode located on the surface of said carrier.

13. The method of claim 12, wherein said single component is generally conductive.

14. The method of claim 13, wherein said component includes at least one material selected from the group consisting of aluminum, silver, copper, nickel, palladium, gold, and a combination of the above materials.

15. An apparatus for forming a particulate tape, comprising:

a carrier having an electrically conductive area on at least one surfaces wherein said electrically conductive area is a part of said carrier; and an electrophoretic deposition bath, wherein a component of a particulate tape may be formed by electrophoretically depositing a particulate material on said conductive surface in said bath; and a means for removing said component from said conductive area of said carrier.

16. The apparatus of claim 15, wherein said carrier is a ribbon.

17. The apparatus of claim 15, wherein said carrier is a belt.

18. The apparatus of claim 15, wherein said carrier is a drum.

19. The apparatus of claim 15, wherein said carrier is a sheet.

20. The apparatus of claim 15, wherein said carrier is a plate.

* * * * *